US005932128A

United States Patent [19]

Dishop

[11] Patent Number: 5,932,128

[45] Date of Patent: Aug. 3, 1999

[54] SWITCHING CONTROL SYSTEM FOR HEATING PANEL WITH LEAKAGE CURRENT CANCELLATION

[75] Inventor: Steven M. Dishop, Bellefontaine, Ohio

[73] Assignee: White Consolidated Industries, Inc., Cleveland, Ohio

[21] Appl. No.: 08/805,508

[22] Filed: Feb. 26, 1997

[51] Int. Cl.[6] ..... H05B 1/02

[52] U.S. Cl. ..... 219/505; 219/501; 219/483; 219/213; 219/412; 219/539; 392/435; 323/319; 338/320

[58] Field of Search ..... 392/435–439; 219/483, 486, 412, 485, 497, 501, 505, 522, 203; 338/306–309, 320; 323/235, 236, 319, 910, 212

[56] References Cited

U.S. PATENT DOCUMENTS

| | | | |
|---|---|---|---|
| Re. 33,529 | 1/1991 | Cremer et al. . | |
| 2,678,990 | 5/1954 | Quirk . | |
| 3,412,234 | 11/1968 | Otavka . | |
| 3,465,121 | 9/1969 | Clark . | |
| 3,465,125 | 9/1969 | McArthur, Jr. . | |
| 3,800,121 | 3/1974 | Dean et al. . | |
| 3,879,652 | 4/1975 | Billings . | |
| 3,958,172 | 5/1976 | Beck . | |
| 4,055,745 | 10/1977 | Balaguer . | |
| 4,100,435 | 7/1978 | Komuro . | |
| 4,136,733 | 1/1979 | Asselman et al. . | |
| 4,163,139 | 7/1979 | Malarkey et al. . | |
| 4,167,696 | 9/1979 | Gyursanszky . | |
| 4,219,857 | 8/1980 | Haraldsson et al. . | |
| 4,298,789 | 11/1981 | Eichelberger et al. . | |
| 4,370,692 | 1/1983 | Wellman, Jr. et al. . | |
| 4,424,439 | 1/1984 | Payne et al. . | |
| 4,506,144 | 3/1985 | Hesford et al. | 219/497 |
| 4,616,125 | 10/1986 | Oppitz . | |
| 4,618,817 | 10/1986 | Holtslander . | |
| 4,816,647 | 3/1989 | Payne . | |
| 4,878,011 | 10/1989 | Holtslander . | |
| 4,885,456 | 12/1989 | Tanaka et al. . | |
| 4,889,974 | 12/1989 | Auding et al. . | |
| 4,897,527 | 1/1990 | Cripps et al. . | |
| 4,900,900 | 2/1990 | Shirae et al. . | |
| 5,038,676 | 8/1991 | Davis et al. | 99/330 |
| 5,051,603 | 9/1991 | Walker . | |
| 5,079,409 | 1/1992 | Takada et al. . | |
| 5,088,389 | 2/1992 | Labadia del Fresno . | |
| 5,128,604 | 7/1992 | Caen | 323/319 |
| 5,164,161 | 11/1992 | Feathers et al. . | |
| 5,182,464 | 1/1993 | Woodworth et al. . | |
| 5,216,303 | 6/1993 | Lu . | |
| 5,221,829 | 6/1993 | Yahav et al. . | |
| 5,235,159 | 8/1993 | Kornrumpf et al. . | |
| 5,245,219 | 9/1993 | Romatzick, Jr. et al. . | |
| 5,293,028 | 3/1994 | Payne . | |
| 5,304,784 | 4/1994 | Tagashira et al. . | |
| 5,367,369 | 11/1994 | Nakai et al. . | |
| 5,410,193 | 4/1995 | Backus et al. . | |
| 5,438,914 | 8/1995 | Höhn et al. . | |
| 5,440,667 | 8/1995 | Simpson et al. . | |

*Primary Examiner*—Mark Paschall

*Attorney, Agent, or Firm*—Pearne, Gordon, McCoy & Granger LLP

[57] ABSTRACT

A heating panel has a substrate with a resistive heating material disposed thereon. The substrate can be metal with an insulating layer disposed between the substrate and the heating layer. Alternatively, the substrate can be glass ceramic. The heating layer has electrodes on opposite edges connected to different phases of a multiphase power source. Another electrode on the heating layer can be connected to a neutral of the power source. Capacitive currents caused in the substrate or a metal object on the substrate by the different phases cancel each other. Thus, leakage current through a conductor connected between the substrate and ground is minimized. The heating panel can be adapted for two phase or three phase systems. Power to the panels is controlled by solid state switches or relays. Zero crossing drivers sense supply voltages and operate the switches to balance currents in the panels. The zero crossing driver operates the corresponding switch or switches to turn the power on or off at a zero crossing of the voltage.

33 Claims, 10 Drawing Sheets

SWITCHING CONTROL SYSTEM FOR HEATING PANEL WITH LEAKAGE CURRENT CANCELLATION

BACKGROUND OF THE INVENTION

This invention relates generally to the field of electric heating and specifically to a controller for multi-phase heating panels.

Ovens and cooktops are commonly heated by one or more of several means, including burning combustible gases and electrical resistance. One form of electrical resistance heating uses monolithic integrated heat sources, known as "heat panels," disposed on walls of the oven or on the cooking surface of the cooktop. Heat panels include a thermally and electrically conductive metal substrate or core covered on one or both faces by an electrically insulative material able to conduct heat. One face of the insulative material has a heating layer or film of electrically resistive material disposed thereon and connected to a current to generate heat. Alternatively, the heating layer is disposed on a glass ceramic substrate. The glass ceramic is crystallized glass that can be used as the cooktop. The heat is conducted from the heating layer through the other layers to the oven cavity or cooking vessel on the cooktop. Examples of such apparatus are shown in U.S. Pat. Nos. 4,298,789 to Eichelberger and 5,577,158 to Källgren and application Ser. No. 08/503,039 filed Jul. 17, 1995 by Källgren, et al, incorporated herein by reference.

Industry standards sometimes require the substrate to be connected to ground. The electrically conductive layers separated by an insulating layer form a capacitor. Thus, when an alternating current (AC) passes through the heating layer, a capacitive AC leakage current caused in one conductor, such as the substrate, and a resistive leakage current through the insulator become leakage current to ground when the substrate is connected to ground. The leakage current to ground will usually exceed industry standards or codes. In addition, if the substrate is connected to neutral or ground of a power source, the leakage current should also be minimized to the power source. If the substrate is floating, the electrical potential that builds up on the substrate should be minimized.

BRIEF SUMMARY OF THE INVENTION

The present invention provides a heating panel and control system including a control input. A heating layer of electrically resistive sheet material is provided on a substrate with an insulating layer disposed between the heating layer and the substrate. First and second electrodes are attached to the heating layer. First and second switches are connected to the respective electrodes and adapted for being electrically connected to different phases of a multiphase power source to control power to the electrodes. A zero crossing driver is connected to the control input, connected to sense voltage in one of the phases, and connected to operate the switches. The zero crossing driver is enabled by the control input to operate the switches at a zero crossing of the voltage in the one phase. Alternatively, the zero crossing driver can be a part of a microprocessor or other controller that operates the switches. A third electrode can be attached to the heating layer and electrically connected to a neutral of the power source.

The invention also provides a heating panel and control assembly including first and second heating panels. Each panel includes a heating layer of electrically resistive sheet material, a substrate of electrically conductive sheet material, and an insulating layer disposed between the heating layer and the substrate. First and second electrodes are attached to the heating layer, the second electrodes being adapted for being electrically connected to a neutral of the power source. First and second switches are connected to the respective first electrodes and are adapted for being electrically connected to different phases of a multiphase power source to control power to the electrodes. A zero crossing driver is connected to a control input, connected to sense voltage in one of the phases, and connected to operate the switches. The zero crossing driver is enabled by the control input to operate the switches at a zero crossing of the voltage in the one phase.

Alternatively, a second zero crossing driver is connected to the control input, connected to sense voltage in one of the phases, and connected to operate the second switch. The second zero crossing driver is enabled by the control input to operate the second switch at a zero crossing of the voltage in the one phase to which the second zero crossing driver is connected. The first zero crossing driver is connected to sense voltage in the first phase and the second zero crossing driver is connected to sense voltage in the second phase.

A third heating panel includes a heating layer of electrically resistive sheet material, a substrate of electrically conductive sheet material, and an insulating layer disposed between the heating layer and the substrate. First and second electrodes are attached to the heating layer, the second electrode of the third panel being electrically connected to the neutral of the power source. A third switch is connected to the first electrode of the third panel and adapted for being electrically connected to a third phase of the multiphase power source. A third zero crossing driver is connected to the control input, connected to sense voltage in the third phase, and connected to operate the third switch. The zero crossing driver is enabled by the control input to operate the third switch at a zero crossing of the voltage in the third phase.

The heating layers are adapted for converting electrical current therethrough to heat energy transferred therefrom. The substrates are adapted for being connected to ground.

DETAILED DESCRIPTION OF THE INVENTION

Figure 1:
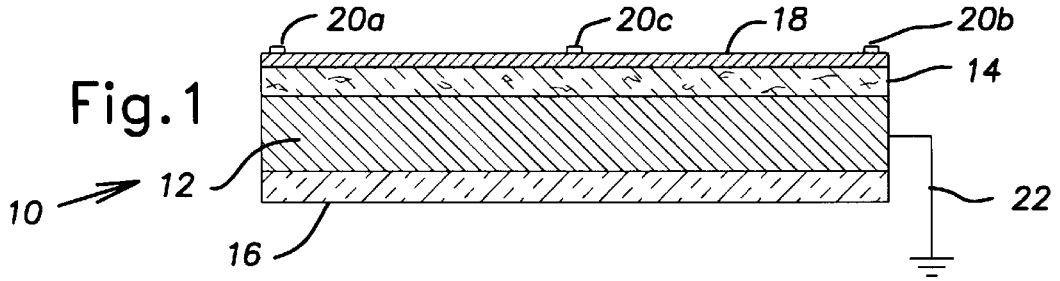
FIG. 1 shows a schematic end view of a heating panel for a two phase system according to the invention.
Figure 1A:
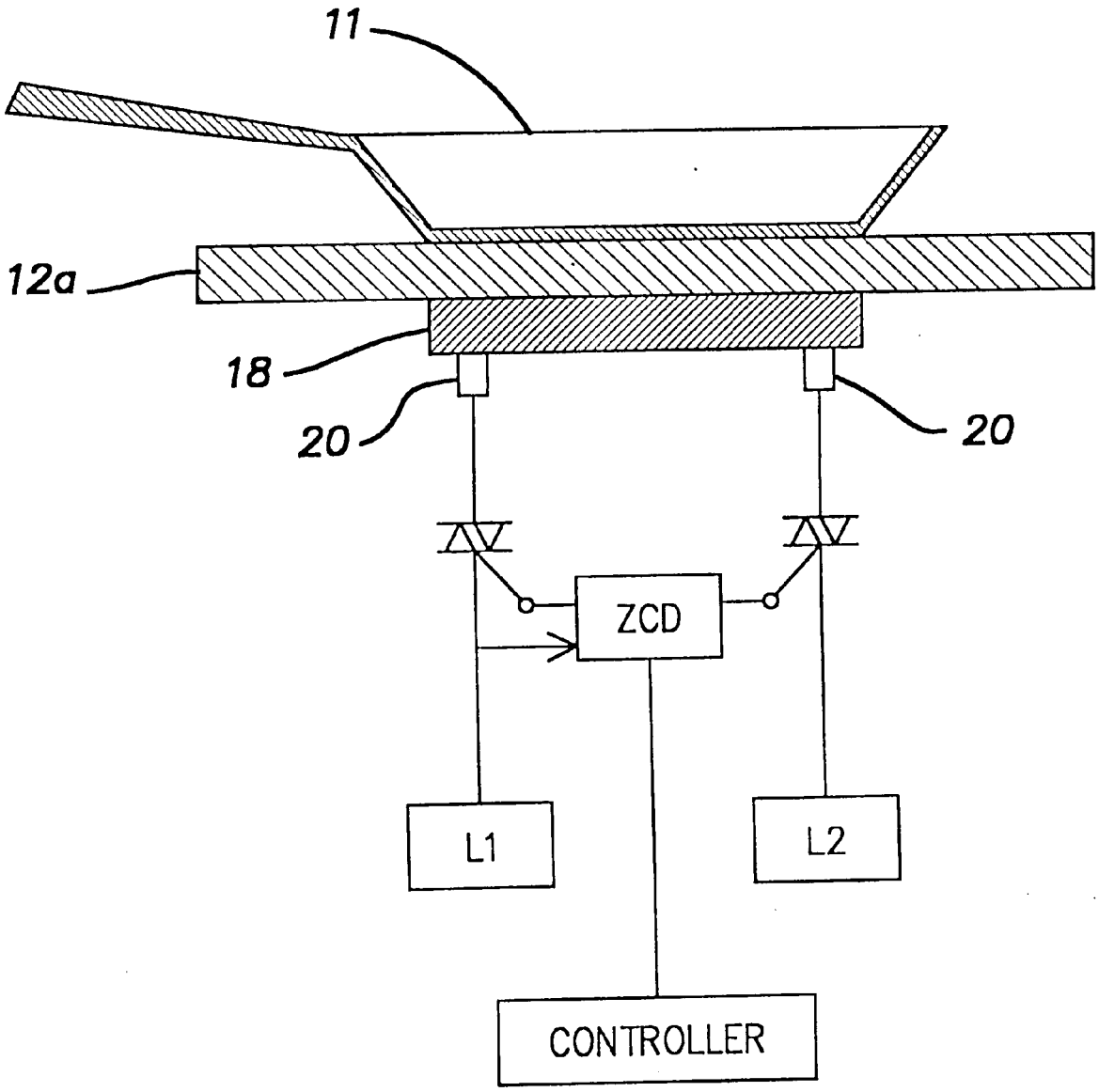
FIG. 1A shows an alternative construction for the heating panel of FIG. 1.

Referring to FIG. 1, a heating panel 10 includes a substrate 12 made of a durable material. The substrate can be an electrically conductive material, such as steel, or an electrically insulative material, such as glass ceramic. The substrate is preferably formed as a rectangular sheet generally defining dimensions of the panel 10. "Panel" refers generally to a flat sheet or other shape, such as a cylinder or bent sheet. An outer insulating layer 14 of dielectric material, such as a ceramic, is applied to at least one face or surface of the substrate 12 so that an interior surface of the outer insulating layer 14 is in thermal communication with the substrate 12. Other suitable insulating materials include porcelain enamel, aluminum oxide, mica and organic polymers. An inner insulating layer 16 of electrically insulating material can be applied to an opposite face of the substrate 12. The inner layer 16 is exposed to the space or object being heated. Referring to FIG. 1A, where the substrate 12a is electrically insulative, such as glass ceramic, the substrate can be exposed directly to the space or object 11 being heated. In the construction of FIG. 1A, the heating layer can be applied directly on the glass ceramic substrate 12*a*. Normally a dielectric, the glass ceramic can become conductive at high temperatures (>300° C.). Therefore, it is desirable in some cases to provide at least one of the insulating layers 14, 16 as shown in FIG. 1. The following description of the controller applies to this construction of the panel as well as that shown in FIGS. 1, 8, 9 and 12.

Figure 8:
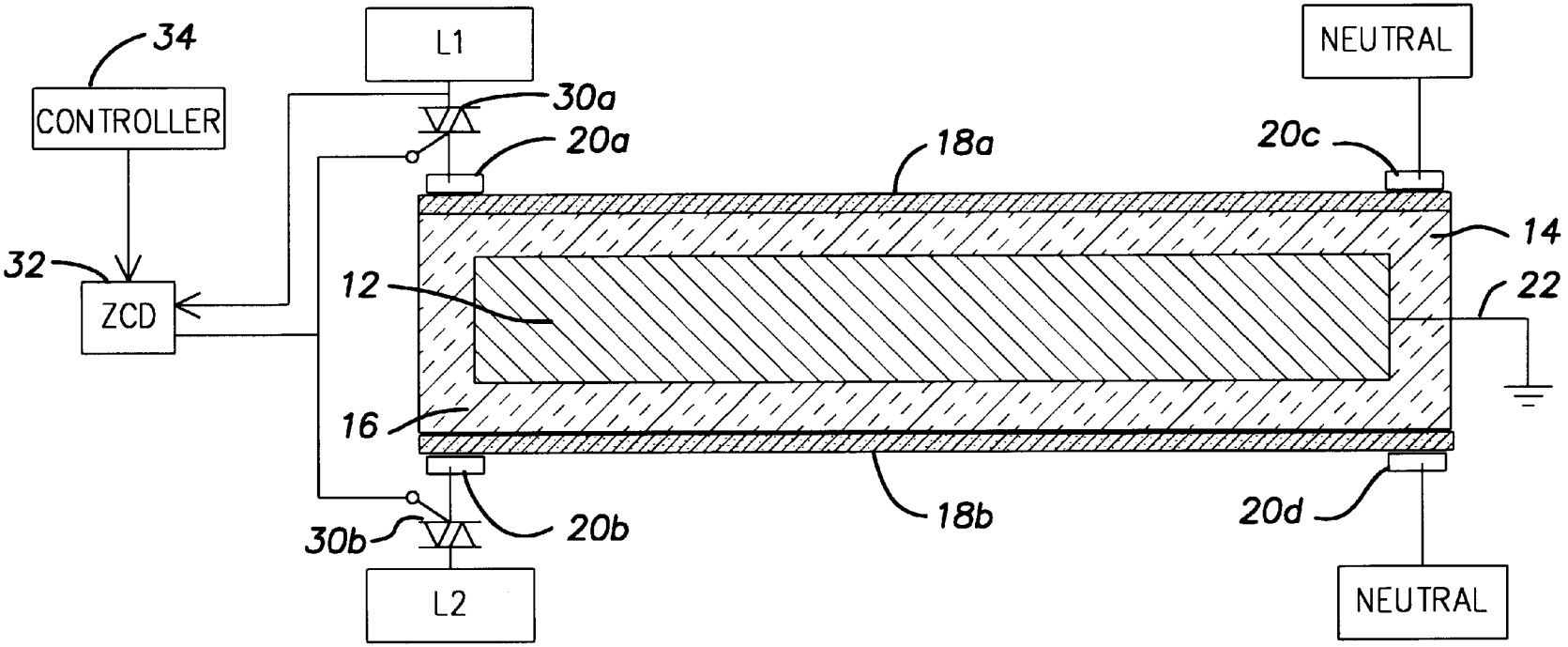
FIG. 8 shows an end view of a heating panel for a two phase system according to another embodiment of the invention.

A heating layer 18 of electrically resistive material, such as graphite, doped oxide, thin film or other resistive thick or thin film, is applied to or deposited on a face or exterior surface of the outer layer 14 opposite the substrate 12. The term "resistive material" will encompass any semiconductive or resistive material having a measurable resistance adapted for conversion of electrical energy into substantial heat energy when a current is passed therethrough, as is apparent from the following description. The outer insulating layer 14 can also include a thin (<1 $\mu$m) film of silicon dioxide between the ceramic and the heating layer 18 to maintain electrical resistance at high temperatures. Other layers can be added to provide desired thermal, mechanical, chemical, or electrical characteristics. The various layers conduct heat from the heating layer to a space or object to be heated. Also, in any of the embodiments, the inner and outer layers 14, 16 can be joined at edges of the substrate to substantially enclose the substrate, as shown in FIG. 8.

The heating panel 10 further includes a plurality of electrically conductive members, such as electrodes 20 (individually designated as 20*a*, 20*b* and 20*c*), attached to the heating layer 18 in electrical communication therewith. The electrodes 20 can be attached directly to the heating layer or mounted on the outer layer 14 with the heating layer deposited thereover. The electrodes 20 are positioned such that the heating layer 18 defines a sheet or film of material extending between the conductors. The electrodes 20 are electrically conductive, elongated bars or braids made of conductive thick film, for example, and provided with connectors, wires, or other means for connecting the electrodes to a source of electrical energy. Preferably, the electrodes are all made of the same material, have the same cross-sectional shape and dimensions, and are the same length.

Figure 2:
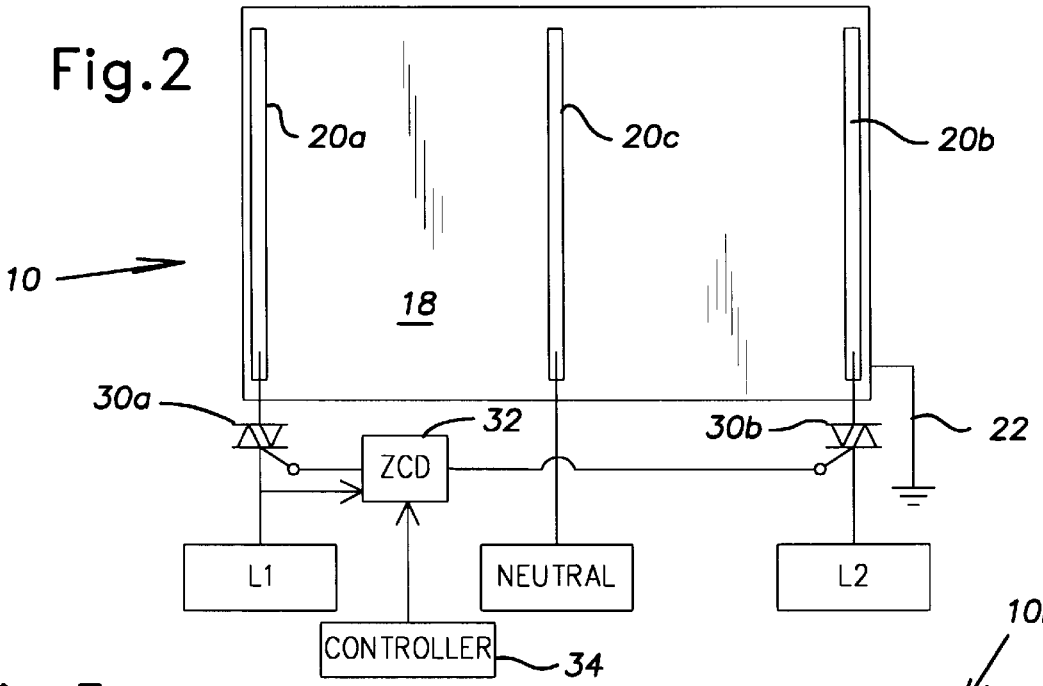
FIG. 2 shows a face of the heating panel connected to a control system.

Referring to FIGS. 1 and 2, a first electrode 20*a* is attached along one edge of the panel 10 and a second electrode 20*b* is attached along a second, generally parallel, edge of the panel. A third electrode 20*c* can be disposed generally parallel with the first and second electrodes 20*a*, 20*b* and about midway therebetween. Preferably, the electrodes 20*a*, 20*b*, 20*c* are precisely evenly spaced.

The first and second electrodes 20*a*, 20*b* are connected to different phases L1, L2 of a multiphase power source, such as a synthetic two phase 240 V household power source, sometimes known as the Edison System. Such a power source is a three wire AC system providing 240 volts across two wires, the third wire being a neutral that can also be used as a ground. The third electrode 20*c* can be connected to a neutral of the power source. As sometimes required by industry standards, the substrate 12 can be connected directly to ground by a suitable grounding conductor 22 or indirectly through the neutral of the power source. The term "ground" refers generally to any such direct or indirect connections to ground or the neutral.

The phases L1, L2 are connected to the electrodes 20*a*, 20*b* through respective controlled switches, such as triacs or relays 30*a*, 30*b*. The triacs 30*a*, 30*b* are connected to control power to the electrodes 20*a*, 20*b*. A zero crossing driver 32 is connected to operate the triacs 30*a*, 30*b*. The zero crossing driver 32 includes a zero crossing sensor connected to sense zero voltage crossings in one of the phases L1, L2. A controller 34 is connected to provide a control input to the zero crossing driver 32 to enable the driver. The controller can be connected to operate a separate zero crossing driver for each phase and switch. The zero crossing driver 32 operates the triacs 30*a*, 30*b* at a zero crossing of the voltage in the phase responsive to an input from the controller 32.

When the controller 34 enables the zero crossing driver 32, the zero crossing driver operates the triacs 30*a*, 30*b* at the next subsequent zero crossing in the first phase L1 voltage. Initially, the zero crossing driver operates the triacs 30*a*, 30*b* to a closed, conducting state. Current flowing through the triacs 30*a*, 30*b* and the heating layer 18 from the power source generates heat, which is conducted through the insulating layers 14, 16 and the substrate 12 to a space or object to be heated. Capacitive currents generated in the substrate 12 by the currents passing through the heating layer 18 cancel each other because the electrodes 20*a*, 20*b* supply current 180° out of phase. When the controller 34 disables the zero crossing driver 32, the triacs 30*a*, 30*b* are operated to an open, nonconductive state at the next subsequent zero crossing in the phase voltage L1. Transient currents in the heating layer 18 are minimized. Thus, little or no leakage current travels through the ground conductor 22 from the capacitor formed by the heating panel 10.

Figure 3:
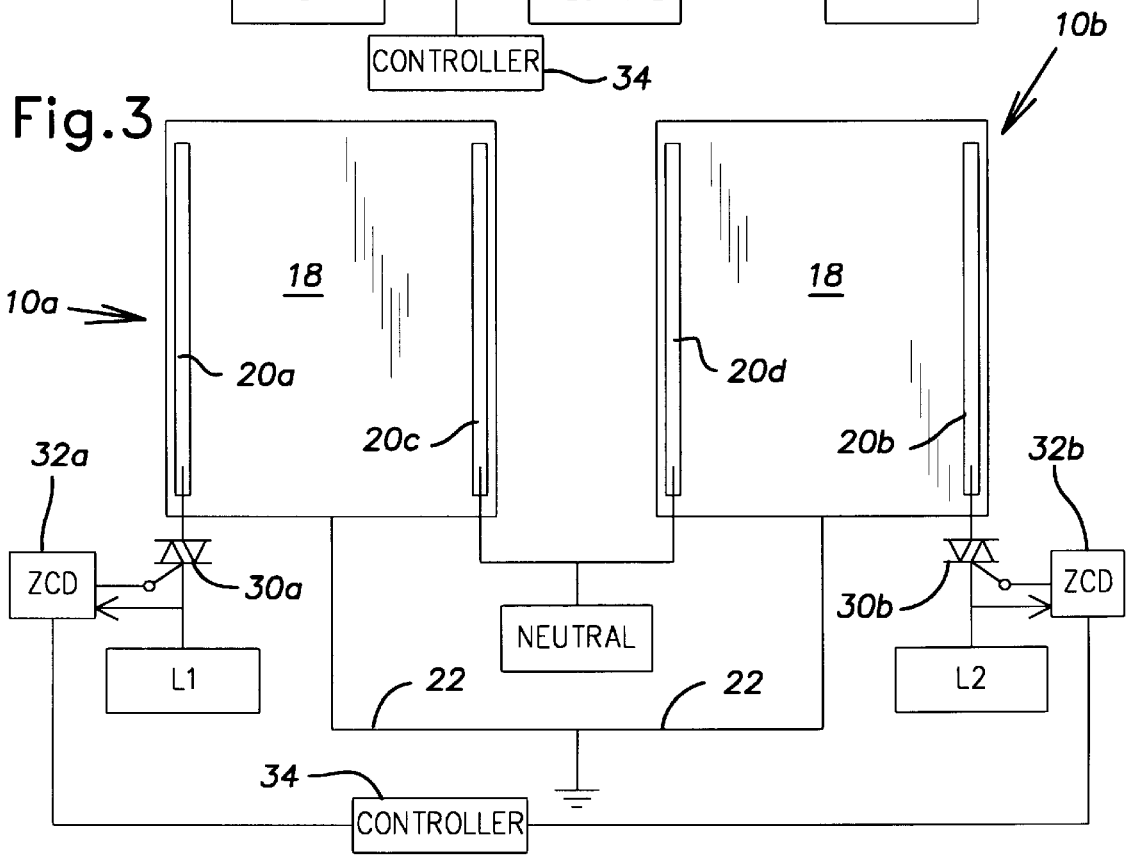
FIG. 3 shows a two heating panel assembly and control system for a two phase system.

Referring to FIG. 3, two heating panels 10*a*, 10*b* are shown. The panels 10 are connected in pairs such that the first electrode 20*a* (on the first panel 10*a*) is connected to the first phase L1 and the second electrode 20*b* (on the second panel 10*b*) is connected to the second phase L2. The first and second electrodes 20*a*, 20*b* are connected to the power source through respective triacs 30*a*, 30*b*. The triacs are operated by respective zero crossing drivers 32*a*, 32*b* connected to sense zero crossings in the voltage of the corresponding phase. The controller 34 is connected to operate both zero crossing drivers 32*a*, 32*b*. The third electrode 20*c* (on the first panel 10*a*) and a fourth electrode 20*d* (on the second panel 10*b*) are connected together and/or to the neutral. The third and fourth electrodes 20*c*, 20*d*, connected to the neutral, are disposed along an edge of the respective panel 10 parallel with and opposite to the corresponding first and second electrodes 20*a*, 20*b*. Substrates of both panels 10*a*, 10*b* are connected to ground through the ground conductor 22.

The zero crossing drivers 32*a*, 32*b* operate the triacs 30*a*, 30*b* responsive to signals from the controller 34 at zero crossings in the respective phases L1, L2. Theoretically, the zero crossing drivers 32*a*, 32*b* will operate the triacs 30*a*, 30*b* simultaneously, however, impedances and other factors might cause the phase voltages to have different zero crossings. Both of the zero crossing drives can be embodied in a microcontroller or other device.

Figure 4:
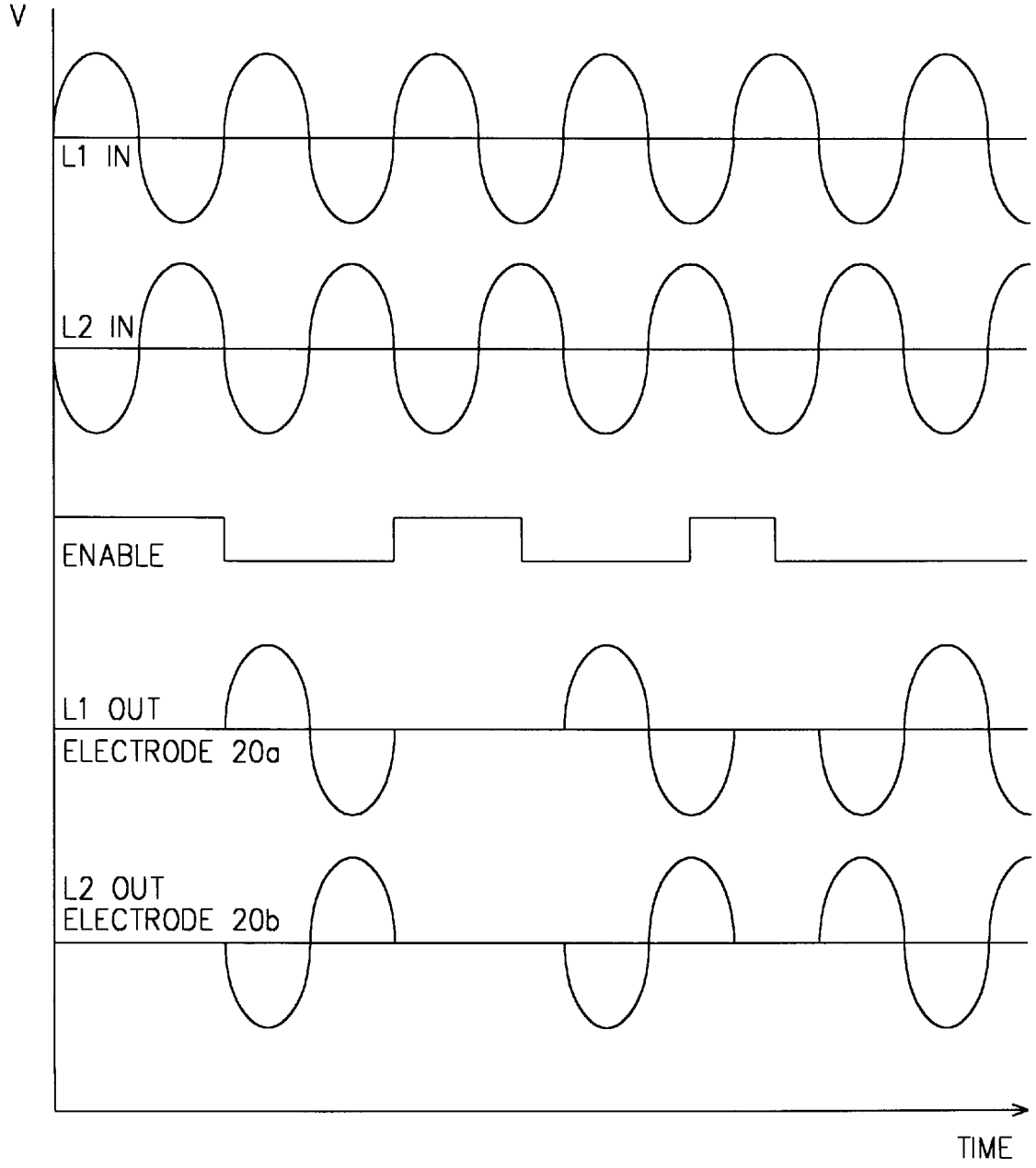
FIG. 4 shows a timing diagram for a two phase system.

Referring to FIG. 4, exemplary timing diagrams for FIGS. 2 and 3 are shown. The power source voltage phases (L1 In, L2 In) are 180° out of phase. When the controller enables the zero crossing driver(s) 32, power (L1 Out:, L2 Out) is supplied to the electrodes 20*a*, 20*b* beginning at the next zero crossing. Power to the electrodes is disconnected at the first zero crossing after the controller disables the zero crossing driver(s). Throughout this description a negative logic enable signal is used, that is, a zero value is an enable signal and a positive value is an inhibit signal.

Figure 5:
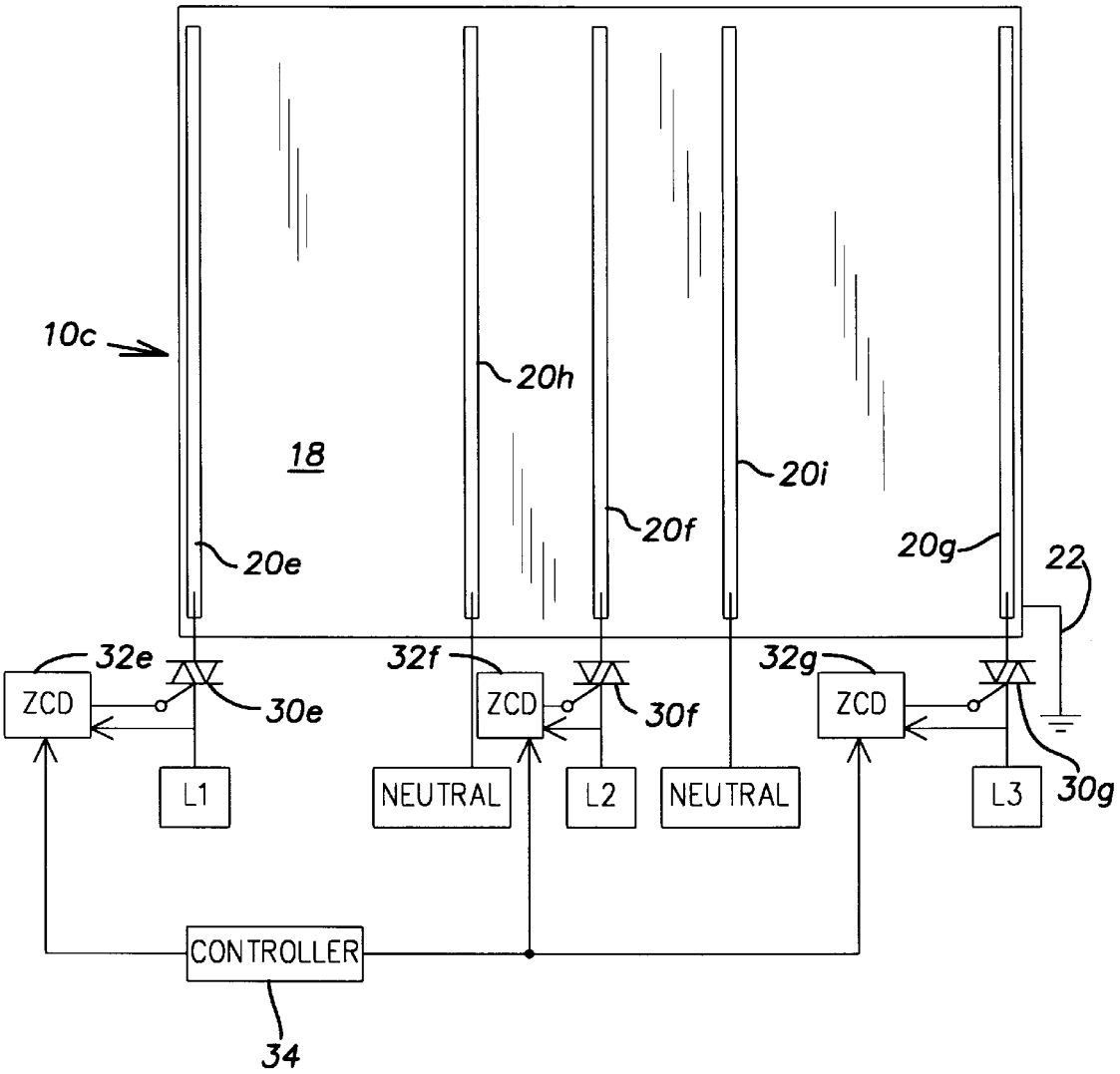
FIG. 5 shows a face of a heating panel for a three phase system.

Referring to FIG. 5, the principles of the present invention also apply where the heating panel 10*c* is connected to a three phase power source. Three electrodes 20*e*, 20*f*, 20*g* are connected to respective phases L1, L2, L3 of the power source. Two of the electrodes 20*e*, 20*g* are disposed along opposite edges of the panel 10*c*, and one of the electrodes 20*f* is disposed near the middle of the panel. Preferably, the electrodes 20*e*, 20*f*, 20*g* are precisely evenly spaced. Two additional electrodes 20*h*, 20*i* are connected to the neutral of the power source and are evenly spaced between pairs of the electrodes 20*e*, 20*f*, 20*g*. Theoretically the electrodes should be precisely spaced, as described, but in practice some adjustment may be required depending on the characteristics of the panel.

The electrodes 20*e*, 20*f*, 20*g* are connected to the power source through respective triacs 30*e*, 30*f*, 20*g*. The triacs are operated by respective zero crossing drivers 32*e*, 32*f*, 32*g* connected to sense zero crossings in the voltage of the corresponding phase. The controller 34 is connected to operate the zero crossing drivers 32*e*, 32*f*, 32*g*. The phases L1, L2, L3 of the power source are displaced 120° with respect to each other. Additional electrodes connected to these phases can be similarly controlled with additional triacs connected to the corresponding zero crossing drivers. Thus, capacitive leakage currents caused in the substrate by the respective phases cancel each other to minimize leakage current through the ground conductor 22.

Figure 6:
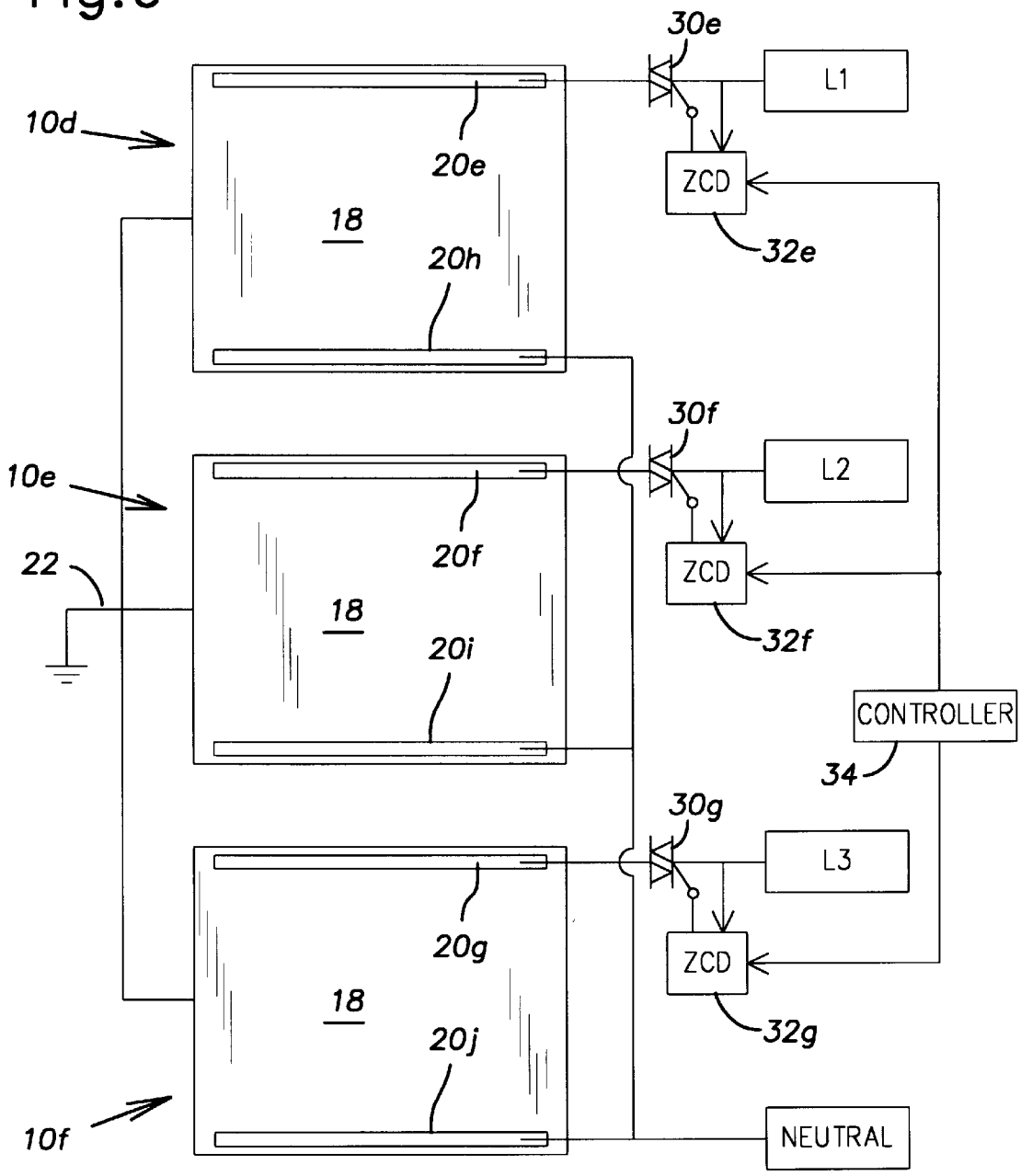
FIG. 6 shows a three heating panel assembly and control system for a three phase system.

Referring to FIG. 6, three heating panels 10*d*, 10*e*, 10*f* are shown. When multiples of three heating panels are connected to a three phase power source in the same system or assembly, only two electrodes 20 are required on each panel. The panels 10 are connected in triads. The first electrode 20*e* (on the first panel 10*d*) is connected to the first phase L1, the second electrode 20*f* (on the second panel 10*e*) is connected to the second phase L2, and the third electrode 20*g* (on the third panel 10*f*) is connected to the third phase L3. Fourth, fifth, and sixth electrodes 20*h*, 20*i*, 20*j*, on respective panels 10*d*, 10*e*, 10*f* are connected together and/or connected to the neutral. The electrodes 20*h*, 20*i*, 20*j* connected together are disposed along an edge of the respective panel 10*d*, 10*e*, 10*f* parallel with and opposite to the corresponding electrodes 20*e*, 20*f*, 20*g* connected to the three phases L1, L2, L3 of the power source. In an alternative connection, the electrodes 20*h*, 20*i*, 20*j* can be connected to phases L2, L3, and L1, respectively, instead of being connected together. Substrates of all panels are grounded through the ground conductor 22. The heating layers 18 can all be applied on a single substrate of metal or glass ceramic or on separate substrates.

The electrodes 20*e*, 20*f*, 20*g* are connected to the power source through respective triacs 30*e*, 30*f*, 20*g*. The triacs are operated by respective zero crossing drivers 32*e*, 32*f*, 32*g* connected to sense zero crossings in the voltage of the corresponding phase. The controller 34 is connected to enable the zero crossing drivers 32*e*, 32*f*, 32*g*. The phases L1, L2, L3 of the power source are displaced 120° with respect to each other. Thus, capacitive leakage currents caused in the substrate by the respective phases cancel each other to minimize leakage current through the ground conductor 22.

Figure 7:
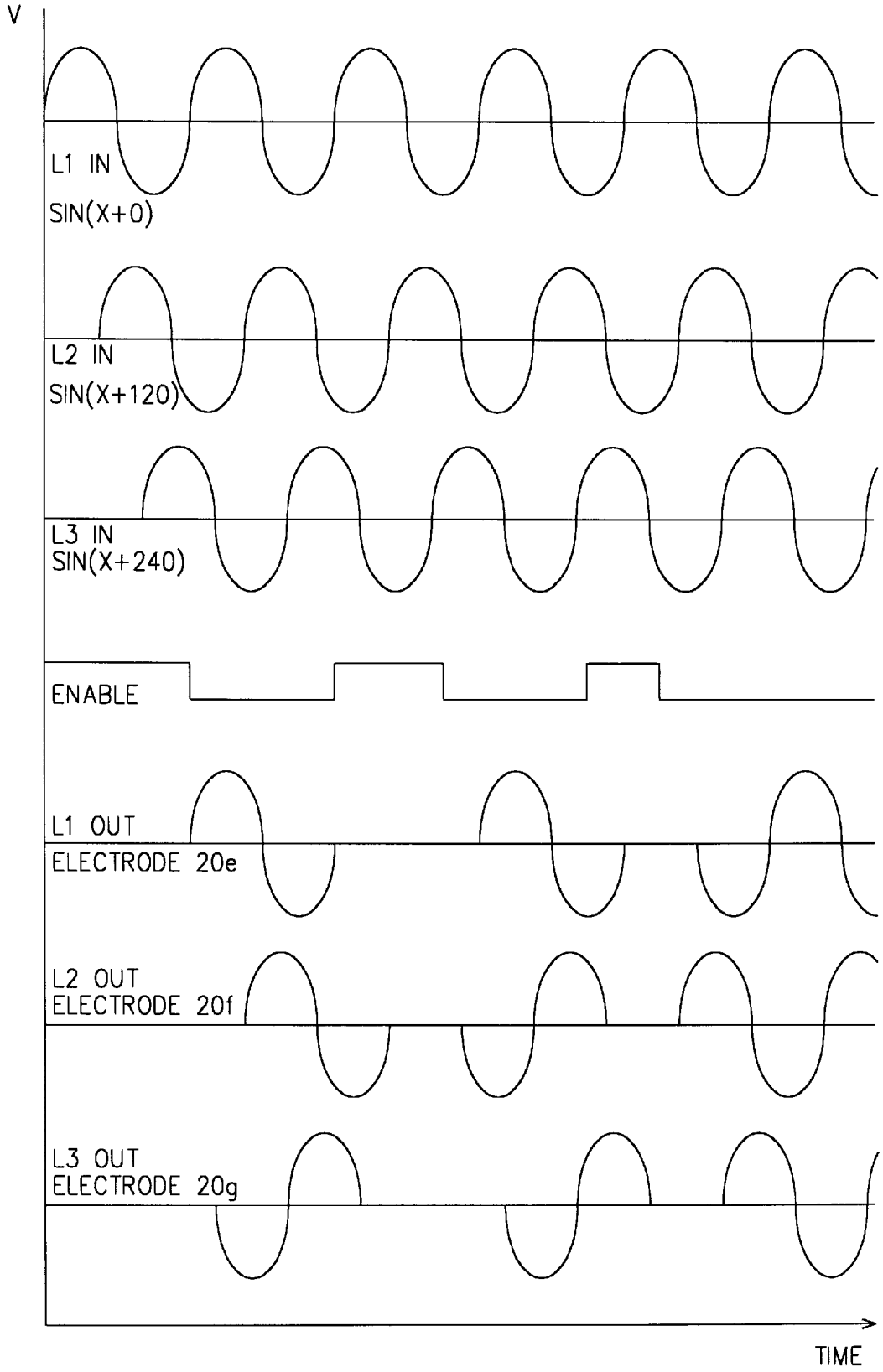
FIG. 7 shows a timing diagram for a three phase system.

Referring to FIG. 7, exemplary timing diagrams for FIGS. 5 and 6 are shown. In systems where zero crossings are not coincident in all phases, such as three phase system, it is preferable to use a separate zero crossing driver for each phase. In the three phase system, the power source voltage phases (L1 In, L2 In, L3 In) are 1200 out of phase. When the controller enables the zero crossing driver(s) 32, power (L1 Out, L2 Out, L3 Out) is supplied to the electrodes 20*e*, 20*f*, 20*g* beginning at the next zero crossing in each phase. Power to the electrodes is disconnected at the first zero crossing in each phase after the controller disables the zero crossing driver(s).

Figure 9:
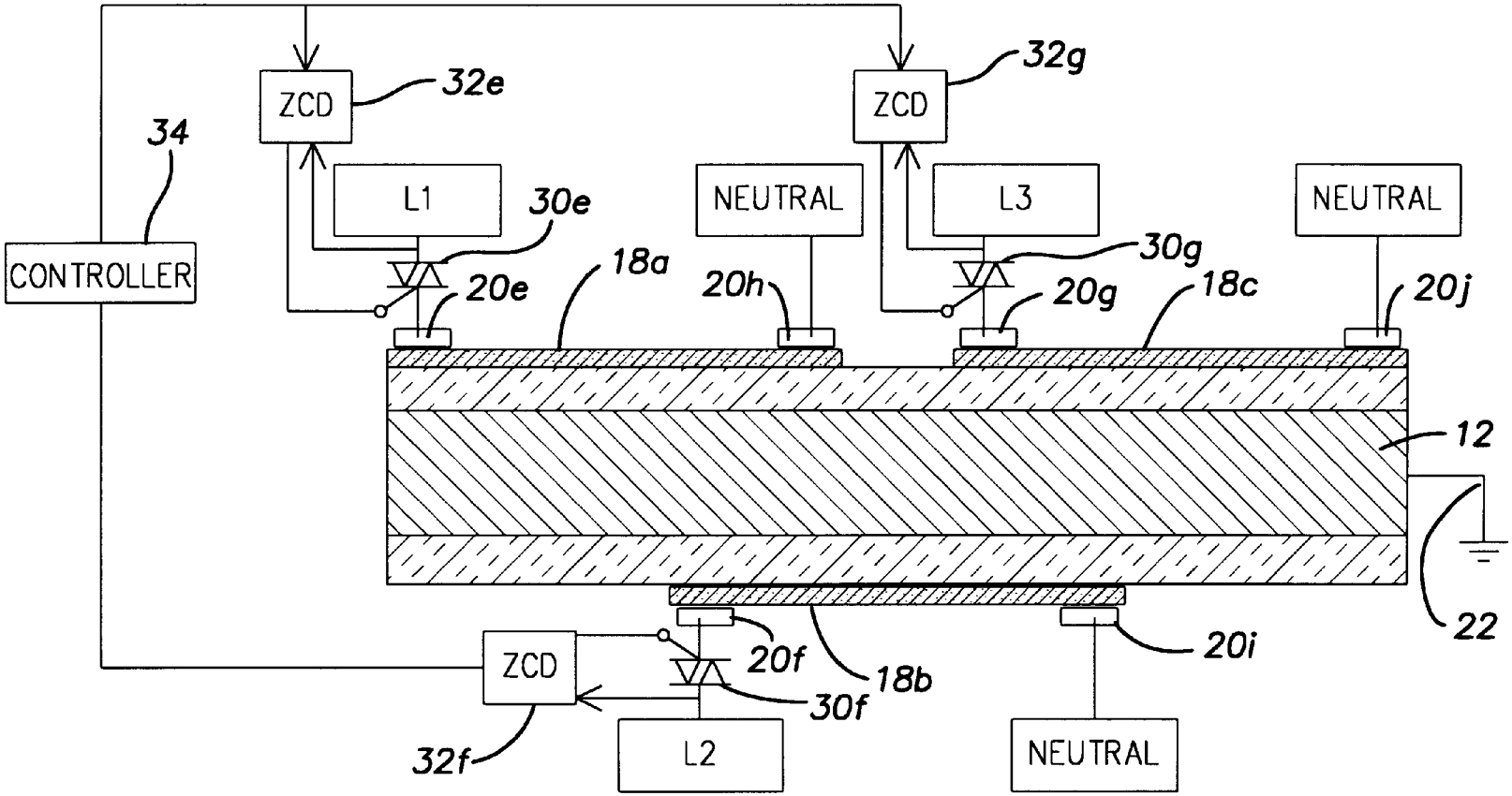
FIG. 9 shows an end view of a heating panel for a three phase system according to another embodiment of the invention.

As shown in FIGS. 8 and 9, plural heating layers can be mounted on single substrate. Referring to FIG. 8, the outer insulating layer 14 and inner insulating layer 16 are disposed on the substrate 12. A first heating layer 18*a* is disposed on the outer insulating layer 14. Two electrodes 20*a*, 20*c* are electrically connected with the heating layer and disposed along opposed edges thereof. One electrode 20*a* is connected to one phase L1 of a two phase power source and the other electrode 20*c* is connected to the neutral. A second heating layer 18*b*, substantially identical with the first, is disposed on the inner insulating layer 16. Two electrodes 20*b*, 20*d* are connected to the second heating layer 18*b* opposite to the electrodes 20*a*, 20*c* on the first heating layer. One electrode 20*b* is connected to the other phase L2 of the two phase power source and the other electrode 20*d* is connected to the neutral. The substrate is connected to ground through the ground conductor 22. This construction is similar to FIG. 3, except that both heating layers are disposed on the same substrate.

The first and second electrodes 20*a*, 20*b* are connected to the power source through respective triacs 30*a*, 30*b*. The triacs are operated by the zero crossing driver 32 connected to sense zero crossings in the voltage of the corresponding phase. The controller 34 is connected to enable the zero crossing driver 32. The zero crossing driver 32 operates the triacs 30*a*, 30*b* responsive to signals from the controller 34 at zero crossings in the respective phases L1, L2.

Referring to FIG. 9, three heating layers 18*a*, 18*b*, 18*c* are disposed on a single substrate 12. In this case, the heating layers are substantially smaller than the substrate 12. Two of the heating layers 18*a*, 18*c* are disposed on one face of the substrate and the other heating layer 18*b* is disposed on the opposite face. Each heating layer has a first electrode 20*e*, 20*f*, 20*g* connected to a different phase L1, L2, L3 of a three phase power source. A second electrode 20*h*, 20*i*, 20*j* on each heating layer is connected to the neutral of the three phases power source. The substrate is connected to ground through the ground conductor 22. This construction is similar to FIG. 6, except that the heating layers are disposed on different faces of the same substrate. As described for FIG.

6, the second electrodes 20*h*, 20*i*, 20*j* can be connected together and the neutral omitted or the second electrodes can be connected to different phases L2, L3, L1, respectively. Additional layers can be applied over the heating layers 18 for electrical insulation and protection.

The electrodes 20*e*, 20*f*, 20*g* are connected to the power source through respective triacs 30*e*, 30*f*, 30*g*. The triacs are operated by respective zero crossing drivers 32*e*, 32*f*, 32*g* connected to sense zero crossings in the voltage of the corresponding phase. The controller 34 is connected to operate the zero crossing drivers 32*e*, 32*f*, 32g. The phases L1, L2, L3 of the power source are displaced 120° with respect to each other. Thus, capacitive leakage currents caused in the substrate by the respective phases cancel each other to minimize leakage current through the ground conductor 22.

Figure 10:
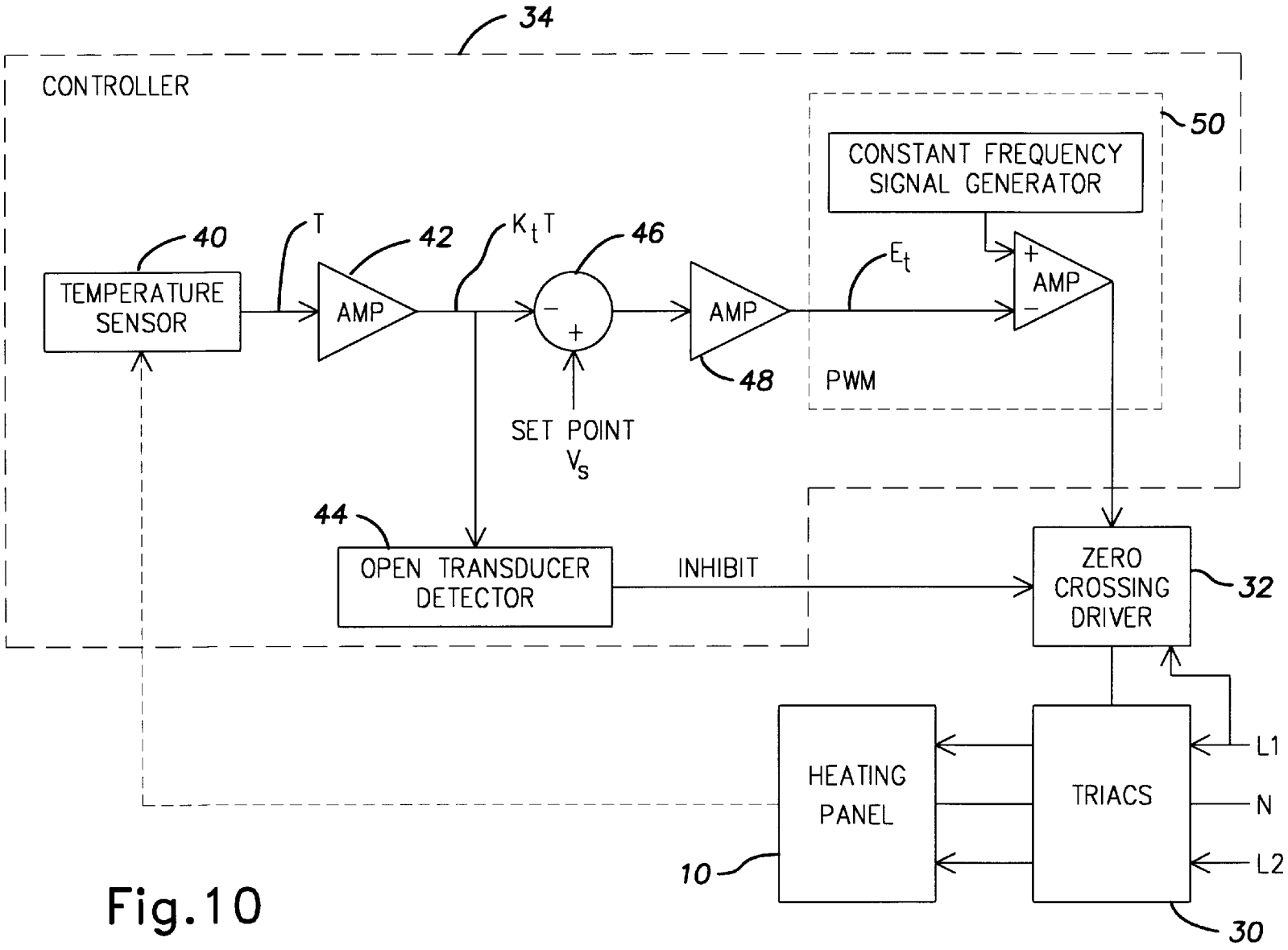
FIG. 10 shows a schematic block diagram of an electric heating circuit according to the invention.
Figure 11:
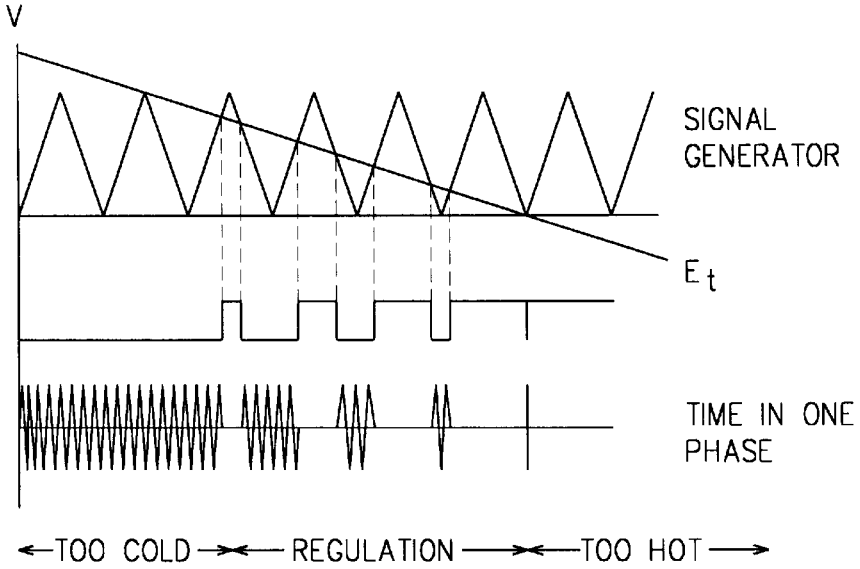
FIG. 11 shows wave form diagrams for the control system.

Referring to FIG. 10, the heating panel 10, triacs 30, zero crossing driver 32, and controller 34 are shown schematically in a b10ck diagram of an electrical heating circuit. The arrangement shown in FIG. 10 is similar to the configuration shown in FIG. 2. The controller 34 includes a temperature sensor 40, such as a temperature to voltage transducer, adapted for sensing a temperature of the heating panel 10 or a space heated by the panel. The temperature sensor signal T can be amplified by a temperature amplifier 42. The amplified signal $K_tT$ or lack thereof can be used to inhibit operation of the zero crossing driver 32 by means of an open transducer detector 44, which detects removal of the temperature sensor or a fault in the temperature sensor. A desired temperature $V_s$ is input to a subtractor 46 that provides a signal representing the difference between the desired temperature $V_s$ and the desired temperature $K_tT$. The difference signal is amplified by an error amplifier 48 to provide an error signal $E_t=K_e(V_s-K_tT)$, where $K_e$ and $K_t$ represent the magnitude of amplification provided by the amplifiers 42, 48. The subtractor 46 and error amplifier 48 define a differential amplifier. The error signal $E_t$ is input to a pulse width modulator 50. The pulse width modulator includes a triangle wave signal generator and a comparator. As shown in FIGS. 10 and 11, when the amplitude of a point on the triangle wave is less than the amplitude of the error signal $E_t$, the pulse width modulator 50 provides an enable signal to the zero crossing driver 32. When the amplitude of a point on the triangle wave is greater than the amplitude of the error signal $E_t$, the pulse width modulator 50 provides an inhibit signal to the zero crossing driver 32. Thus, the zero crossing driver 32 is disabled when the error signal is negative, indicating that the sensed temperature is too high. The zero crossing driver is enabled intermittently for regulating the temperature within a desired range when the error signal is a small positive value, indicating the temperature is in a desired range immediately below the desired temperature. The zero crossing driver is enabled continuously when the error signal is a large positive value, indicating that the sensed temperature is too low. The enabling control input signal can be pulse width modulated, as described, or a single pulse that acts as an enabling or disabling signal. The range for regulating the temperature can be varied in width and location with respect to the desired temperature. Other analog control schemes can also be used. Equivalent means for controlling the triac switches 30 include a microprocessor or other digital control.

Figure 12:
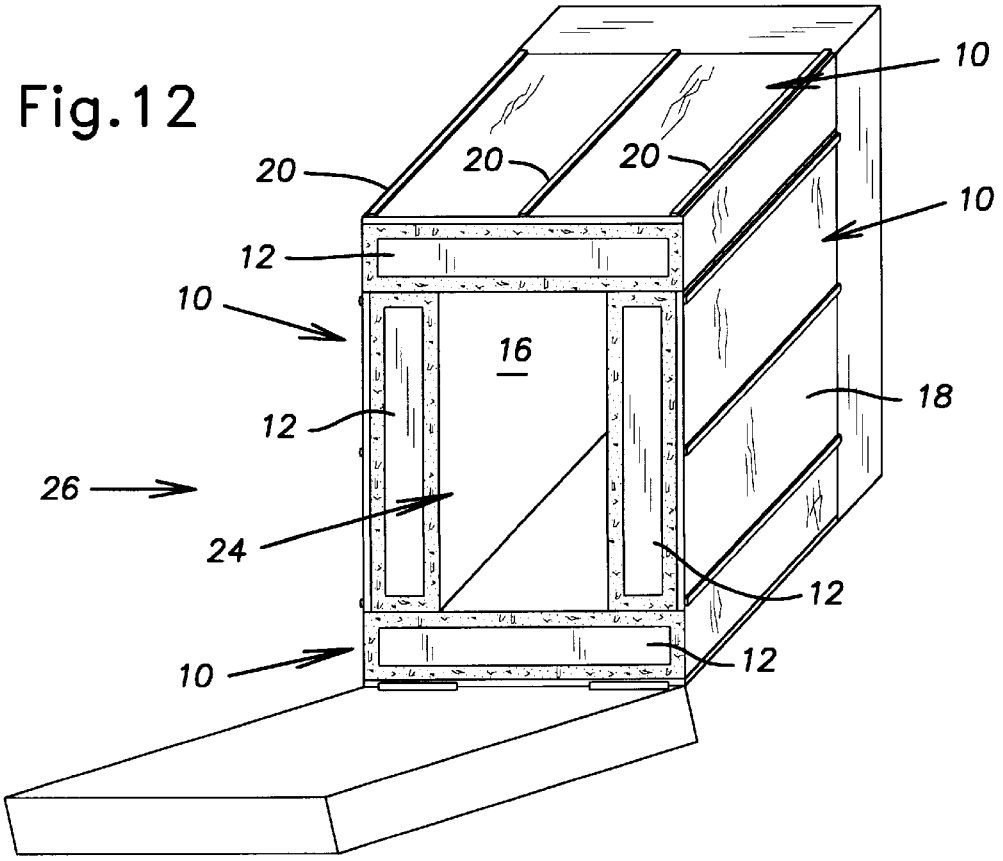
FIG. 12 shows heating panels arranged to form an oven.

Referring to FIG. 12, six heating panels 10 are arranged to form a heating cavity 24 of an oven 26, such as a domestic range used for cooking food. Four heating panels define sides of the generally parallelepipedic heating cavity, one heating panel defines the back wall, and one is pivotably mounted to define a door of the oven 26. The inner insulating layers 16 of the heating panels face inwardly toward the heating cavity 24. FIG. 12 is not to scale and the heating panels 10 are substantially thinner than they appear. The heating panels 10 can be mounted on an existing oven structure or integrally manufactured with the oven structure. The panels 10 shown have three electrodes so that each panel can be separately connected to a multiphase power source, including the neutral. The heating panels can be separately controlled, as described above with reference to FIGS. 2 or 5. The neutral connection can also be eliminated. Since the number of panels is divisible by two and three, the panels can be provided with only two electrodes 20 and connected in a two phase or three phase system in pairs or triads, respectively, as described above with reference to FIGS. 3 or 6.

The present disclosure describes several embodiments of the invention, however, the invention is not limited to these embodiments. Other variations are contemplated to be within the spirit and scope of the invention and appended claims.

What is claimed is:

1. A heating panel and control system comprising:

a control input;

a substrate;

a heating layer of electrically resistive sheet material disposed on a face of the substrate;

first and second electrodes attached to the heating layer;

first and second switches each connected to the respective electrodes and adapted for being electrically connected to different phases of a multiphase power source to control power to the electrodes; and a zero crossing driver connected to the control input, connected to sense voltage in one of the phases, and connected to operate the switches, wherein the zero crossing driver is enabled by the control input to operate the switches at a zero crossing of the voltage in the one phase.

2. A heating panel according to claim 1, further comprising an insulating layer disposed between the substrate and the heating layer.

3. A heating panel according to claim 2, wherein the substrate is an electrically conductive sheet material.

4. A heating panel according to claim 1, wherein the substrate is glass ceramic.

5. A heating panel and control system according to claim 1, further comprising a third electrode attached to the heating layer and adapted for being electrically connected to a neutral of the power source.

6. A heating panel and control system according to claim 1, wherein the heating layer is adapted for converting electrical current therethrough to heat energy transferred therefrom.

7. A heating panel and control system according to claim 1, wherein the substrate is connected to ground.

8. A heating panel according to claim 1, wherein the zero crossing driver is connected to sense voltage in only one of the phases.

9. A heating panel according to claim 8, wherein the zero crossing driver is connected to operate the first and second switches substantially simultaneously.

10. A heating panel according to claim 1, wherein each connection of one of the electrodes to one of the phases is made through one of the switches controlled by one of the zero crossing drivers.

11. A heating panel and control system comprising:

first and second heating panels, each panel comprising a substrate; a heating layer of electrically resistive sheet material disposed on the substrate; and first and second electrodes attached to the heating layer, the second electrodes being adapted for being electrically connected to a neutral of the power source;

first and second switches each connected to the respective first electrodes and adapted for being electrically connected to different phases of a multiphase power source to control power to the electrodes;

a control input; and a zero crossing driver connected to the control input, connected to sense voltage in one of the phases, and connected to operate the switches, wherein the zero crossing driver is enabled by the control input to operate the switches at a zero crossing of the voltage in the one phase.

12. A system according to claim 11, wherein the substrate is an electrically conductive sheet material and further comprising an insulating layer disposed between the substrate and the heating layer.

13. A heating panel and control system according to claim 11, wherein the substrates of the panels are electrically connected to ground.

14. A heating panel according to claim 11, wherein each connection of one of the electrodes to one of the phases is made through one of the switches controlled by one of the zero crossing drivers.

15. A heating panel and control system comprising:

first and second heating panels, each panel comprising a substrate; a heating layer of electrically resistive sheet material disposed on the substrate; and first and second electrodes attached to the heating layer, the second electrodes being adapted for being, electrically connected to a neutral of the power source;

first and second switches each connected to the respective first electrodes and adapted for being electrically connected to different phases of a multiphase power source to control power to the electrodes;

a control input;

a first zero crossing driver connected to the control input, connected to sense voltage in one of the phases, and connected to operate the first switch, wherein the zero crossing driver is enabled by the control input to operate the first switch at a zero crossing of the voltage in the one phase to which the first zero crossing driver is connected; and a second zero crossing driver connected to the control input, connected to sense voltage in one of the phases, and connected to operate the second switch, wherein the second zero crossing driver is enabled by the control input to operate the second switch at a zero crossing of the voltage in the one phase to which the second zero crossing driver is connected.

16. A heating panel and control system according to claim 15, wherein the first zero crossing driver is connected to sense voltage in the first phase and the second zero crossing driver is connected to sense voltage in the second phase.

17. A heating panel and control system according to claim 15, wherein the substrates of the panels are electrically connected to ground.

18. A heating panel and control system according to claim 15, further comprising:

a third heating panel comprising a substrate; a heating layer of electrically resistive sheet material disposed on the substrate; and first and second electrodes attached to the heating layer;

a third switch connected to the first electrode of the third panel and adapted for being electrically connected to a third phase of the multiphase power source; and a third zero crossing driver connected to the control input, connected to sense voltage in the third phase, and connected to operate the third switch, wherein the zero crossing driver is enabled by the control input to operate the third switch at a zero crossing of the voltage in the third phase.

19. A heating panel and control system according to claim 18, wherein the substrates of the panels are adapted for being electrically connected to ground.

20. A heating panel according to claim 15, wherein each connection of one of the electrodes to one of the phases is made through one of the switches controlled by one of the zero crossing drivers.

21. A heating panel and control system comprising:

a heating panel comprising a heating layer of electrically resistive sheet material; a substrate of electrically conductive sheet material; an insulating layer disposed between the heating layer and the substrate; and first and second electrodes attached to the heating layer;

first and second switches each connected to the respective first and second electrodes and adapted for being electrically connected to different phases of a multiphase power source to control power to the electrodes;

a control input;

a first zero crossing driver connected to the control input, connected to sense voltage in one of the phases, and connected to operate the first switch, wherein the zero crossing driver is enabled by the control input to operate the first switch at a zero crossing of the voltage in the one phase to which the first zero crossing driver is connected; and a second zero crossing driver connected to the control input, connected to sense voltage in one of the phases, and connected to operate the second switch, wherein the second zero crossing driver is enabled by the control input to operate the second switch at a zero crossing of the voltage in the one phase to which the second zero crossing driver is connected.

22. A heating panel and control system according to claim 21, further comprising a third electrode adapted for being electrically connected to a neutral of the power source.

23. A heating panel and control system according to claim 21, wherein the first zero crossing driver is connected to sense voltage in the first phase and the second zero crossing driver is connected to sense voltage in the second phase.

24. A heating panel and control system according to claim 21, wherein the substrate of the panel is adapted for being electrically connected to ground.

25. A heating panel according to claim 21, wherein each connection of one of the electrodes to one of the phases is made through one of the switches controlled by one of the zero crossing drivers.

26. A heating panel and control system comprising:

a control input;

a substrate;

a heating layer of electrically resistive sheet material disposed on a face of the substrate;

first, second, and third electrodes attached to the heating layer;

first, second, and third switches each connected to the respective electrodes and adapted for being electrically connected to different phases of a multiphase power source to control power to the electrodes; and first, second, and third zero crossing drivers connected to the control input, connected to sense voltage in the respective phases, and connected to operate the respective switches, wherein the zero crossing drivers are enabled by the control input to operate the respective switches at a zero crossing of the voltage in the respective phases.

27. A system according to claim 25, wherein the substrate is an electrically conductive sheet material and further comprising an insulating layer disposed between the substrate and the heating layer.

28. A heating panel and control system according to claim 25, further comprising a fourth and a fifth electrode attached to the heating layer and electrically connected to a neutral of the power source.

29. A heating panel and control system according to claim 25, wherein the substrate is connected to ground.

30. A heating panel according to claim 26, wherein each connection of one of the electrodes to one of the phases is made through one of the switches controlled by one of the zero crossing drivers.

31. An oven comprising:

an enclosure defining a generally parallelepipedic cooking cavity having five walls closed by a door;

a heating panel disposed on at least one of walls and the door, the heating panel comprising:

a heating layer of electrically resistive sheet material;

a substrate of electrically conductive sheet material;

an electrically insulating material substantially enclosing the substrate to define inner and outer insulating layers, said outer insulating layer being disposed between the heating layer and the substrate and said inner insulating layer facing the cavity;

a first electrode attached along an edge of the heating layer and adapted for being electrically connected to one phase of a multiphase power source;

a second electrode attached along an edge of the heating layer opposite from the first electrode and adapted for being electrically connected to a second phase of the multiphase power source;

a control input;

first and second switches each connected to the respective electrodes and adapted fcr being electrically connected to different phases of a multiphase power source to control power to the electrodes; and a zero crossing driver connected to the control input, connected to sense voltage in one of the phases, and connected to operate at least one of the switches, wherein the zero crossing driver is enabled by the control input to operate the switch at a zero crossing of the voltage in the one phase.

32. An oven according to claim 31, further comprising a third electrode attached to the heating layer between the first and second electrodes and adapted for being electrically connected to a neutral of the multiphase power source.

33. A heating panel according to claim 31, wherein each connection of one of the electrodes to one of the phases is made through one of the switches controlled by one of the zero crossing drivers.

* * * * *

UNITED STATES PATENT AND TRADEMARK OFFICE

CERTIFICATE OF CORRECTION

PATENT NO. : 5,932,128
DATED : August 3, 1999
INVENTOR(S) : Dishop

It is certified that error appears in the above-identified patent and that said Letters Patent is hereby corrected as shown below:

Column 5, Line 15, delete "Out:," and insert --Out,--.

Column 6, Line 20, delete "1200" and insert --120°--.

Column 7, Line 19, delete "b10ck" and insert --block--.

Column 8, Line 40, Claim 1, after "phase" insert --such that leakage currents caused by the respective phases cancel each other--.

Column 9, Line 18, Claim 11, after "phase" insert --such that leakage currents caused by the respective phases cancel each other--.

Column 9, Line 56, Claim 15, after "connected" insert --such that leakage currents caused by the respective phases cancel each other--.

UNITED STATES PATENT AND TRADEMARK OFFICE

CERTIFICATE OF CORRECTION

PATENT NO. : 5,932,128

DATED : August 3, 1999

INVENTOR(S) : Dishop

It is certified that error appears in the above-identified patent and that said Letters Patent is hereby corrected as shown below:

Column 10, Line 43, Claim 21, after "connected" insert --such that leakage currents caused by the respective phases cancel each other--.

Column 11, Line 9, Claim 26, after "phases" insert --such that leakage currents caused by the respective phases cancel each other--.

Column 11, Line 10, Claim 27, delete "25," and insert --26,--.

Column 11, Line 15, Claim 28, delete "25," and insert --26,--.

Column 11, Line 19, Claim 29, delete "25," and insert --26,--.

Column 12, Line 13, Claim 31, delete "fcr" and insert --for--.

Column 12, Line 21, Claim 31, after "phase" insert --such that leakage currents caused by the respective phases cancel each other--.

Signed and Sealed this

Seventh Day of March, 2000

*Attest:*

*Attesting Officer*

Q. TODD DICKINSON

*Commissioner of Patents and Trademarks*